US006733118B2

(12) United States Patent
Pingrey et al.

(10) Patent No.: US 6,733,118 B2
(45) Date of Patent: May 11, 2004

(54) SIDE PLUG FOR AN INK-JET CARTRIDGE, AND CARTRIDGE ASSEMBLY METHODS

(75) Inventors: Brent N Pingrey, Corvallis, OR (US); Zak Fath, Raleigh, NC (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/262,906

(22) Filed: Oct. 2, 2002

(65) Prior Publication Data

US 2004/0066433 A1 Apr. 8, 2004

(51) Int. Cl.[7] ..... B41J 2/175
(52) U.S. Cl. ..... 347/87
(58) Field of Search ..... 347/43, 86, 87; 264/245, 249, 251, 250, 263

(56) References Cited

U.S. PATENT DOCUMENTS 4,771,295 A * 9/1988 Baker et al. ..... 347/87
5,497,178 A * 3/1996 DeFosse et al. ..... 347/87
6,260,961 B1 7/2001 Seu et al.
6,290,348 B1 * 9/2001 Becker et al. ..... 347/87
6,488,368 B2 * 12/2002 Petersen et al. ..... 347/85

* cited by examiner

*Primary Examiner*—Anh T. N. Vo
(74) *Attorney, Agent, or Firm*—Larry Baker

(57) ABSTRACT

A side plug for an ink-jet cartridge body, and methods of attaching the side plug to the cartridge body, are disclosed. The side plug seals a mold access hole in the cartridge body. The side plug is preferably formed of a carbon fiber filled PET (Polyethylene Terephthalate) material; the carbon content of the side plug allows microwave curing of the epoxy adhesive used to attach the side plug to the cartridge body. The side plug may have sculpted protuberances which extend into the cartridge body to form complex ink channels.

23 Claims, 7 Drawing Sheets

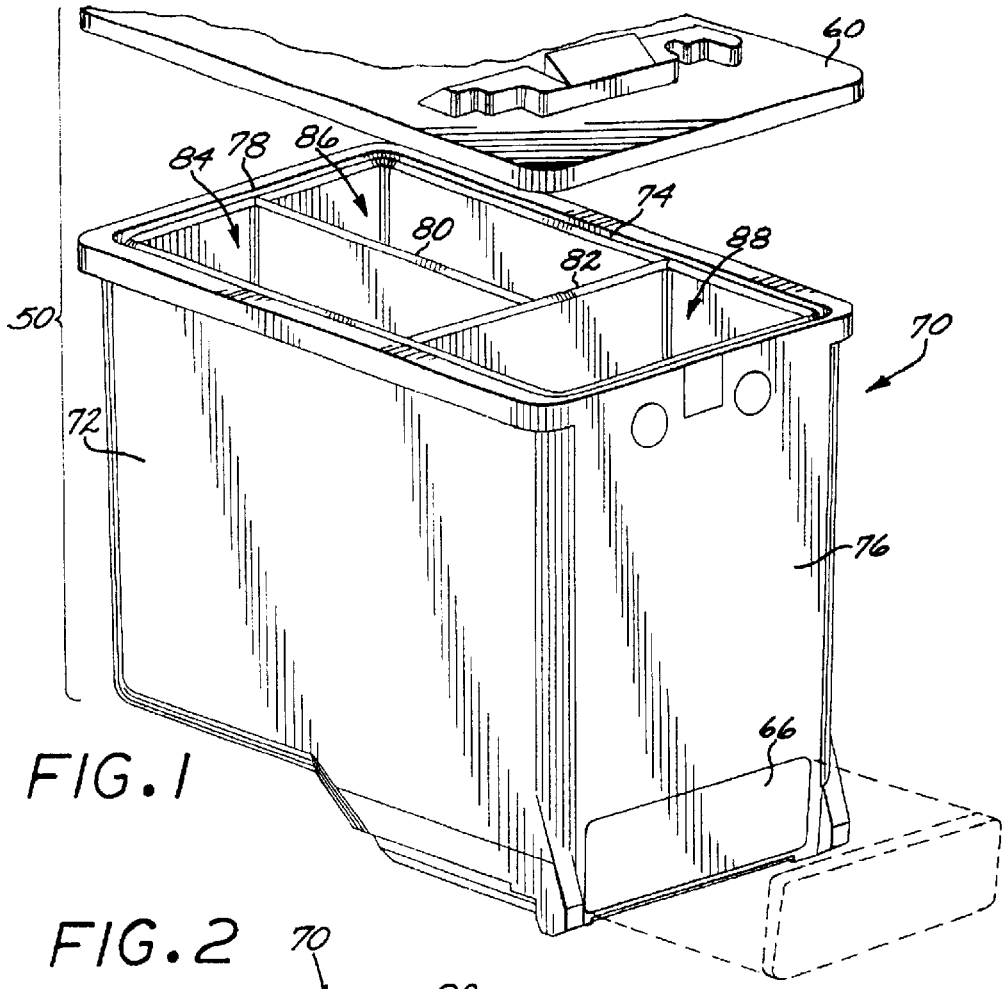
FIG. 1
FIG. 2
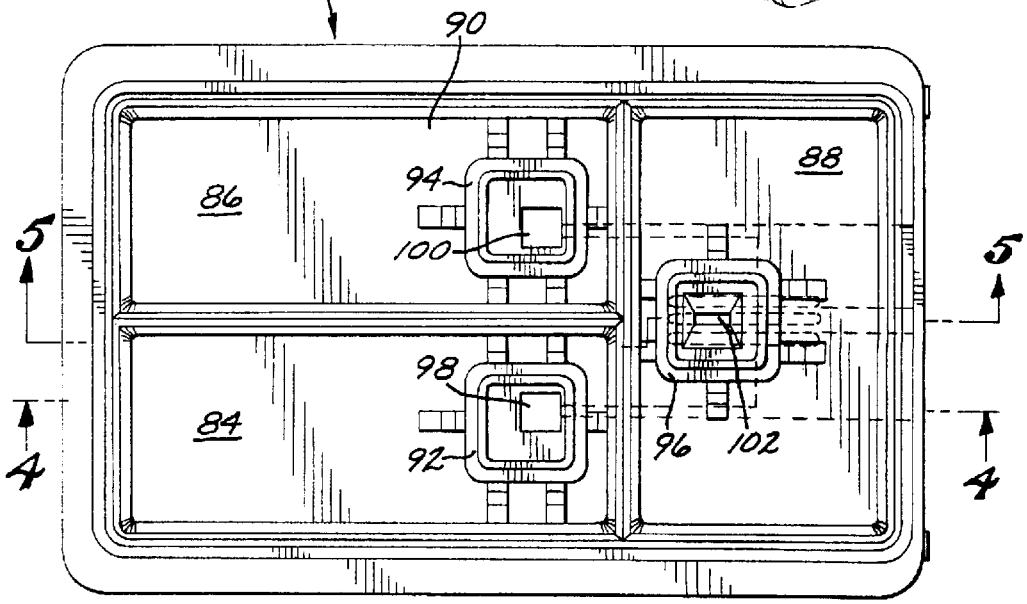

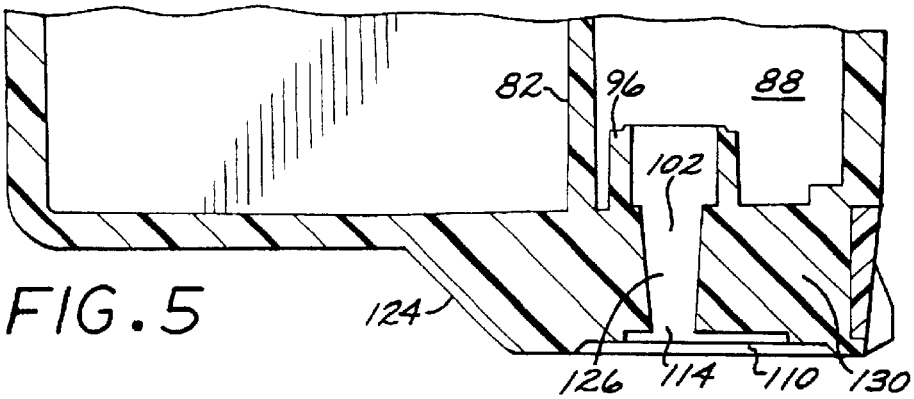
FIG. 5
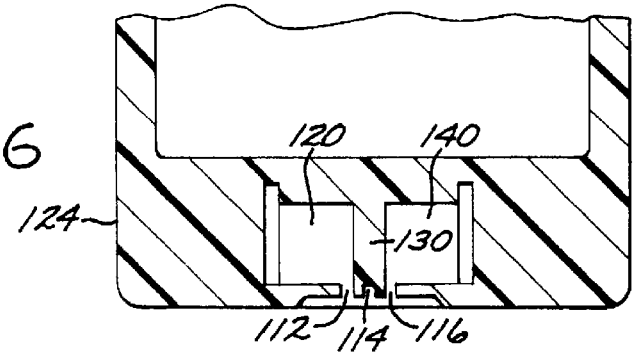
FIG. 6
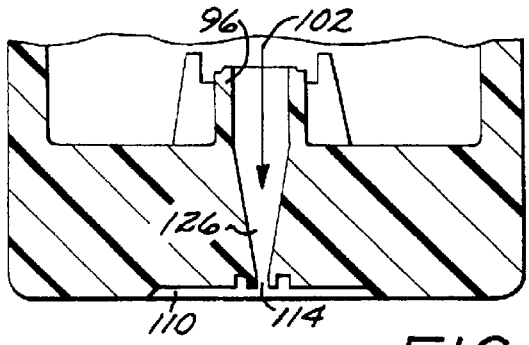
FIG. 7
FIG. 8
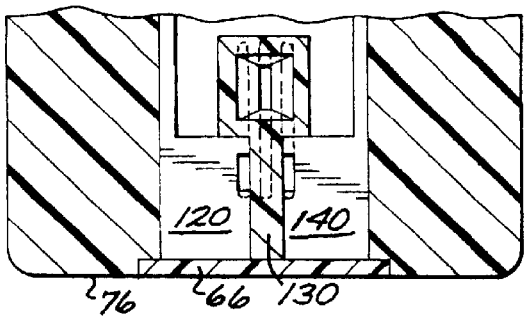
FIG. 9
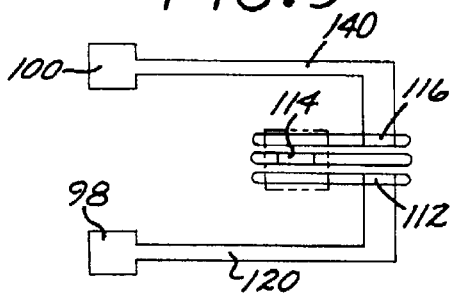

SIDE PLUG FOR AN INK-JET CARTRIDGE, AND CARTRIDGE ASSEMBLY METHODS

TECHNICAL FIELD OF THE INVENTION

The present invention relates to components for ink-jet cartridges, and techniques for constructing ink-jet print cartridges.

BACKGROUND OF THE INVENTION

Ink-jet printers are in widespread use today for printing functions in personal computer, facsimile and other applications. Such printers typically include replaceable or semi-permanent print cartridges which hold a supply of ink and carry the ink-jet printhead. The cartridge typically is secured into a printer carriage which supports one or a plurality of cartridges above the print medium, and traverses the medium in a direction transverse to the direction of medium travel through the printer. Electrical connections are made to the printhead by flexible wiring circuits attached to the outside of the cartridge. Each printhead includes a number of tiny nozzles defined in a substrate and nozzle plate structure that are selectively fired by electrical signals applied to interconnect pads to eject droplets of ink in a controlled fashion onto the print medium.

Multicolor cartridges are known which have multiple ink reservoirs and multiple printhead nozzle arrays, one of each for each different color of ink. A manifold structure is typically employed to direct the inks of different colors from the respective reservoirs to corresponding printhead nozzle arrays. The cartridges typically include a body structure to which the printhead structure is attached. Typically the body structures and manifolds for multicolor cartridges have been assembled from multiple plastic parts, which are then bonded together by techniques such as ultrasonic welding or adhesives. Leaks and mislocation of the respective parts are commonly encountered problems.

One method which has been utilized to economically produce cartridges is to form the body and manifold as a unitary one-piece structure fabricated of a plastic material using an injection molding process, as described in U.S. Pat. No. 6,260,961, "Unitary One-Piece Body Structure For Ink-Jet Cartridge." A lid is then attached to the unitary body to cover the compartments. To form the manifold region of the cartridge adjacent to the printheads, a mold slide insert may be utilized, resulting in a mold access hole in the cartridge body that must be sealed with a plug. To optimize air management, facilitate ink fill, and help prevent printhead deprime, the plug may have sculpted protuberances which extend into the cartridge body to form complex ink channels.

To prevent ink leaks, it is important that the plug form a reliable seal with the cartridge body. The seal must withstand prolonged contact with chemically aggressive inks, and must mechanically support the plug protuberances forming the ink channels. The seal may be subjected to significant stress during subsequent manufacturing steps, such as during ultrasonic welding of the cartridge lid to the cartridge body. The attachment process of the plug to the cartridge body must also not add undue manufacturing costs.

One cost effective method of bonding plastic parts together is with heat cured adhesives. Bonding plastic parts together with heat cured adhesives can be problematic, however, due to difficulties encountered in heating the adhesive. The plastic parts being joined can obstruct direct heating of the adhesive by hot air or infrared heating methods. Heat must then be transferred through one or both of the surfaces being bonded. Heat transfer through plastic is often poor and elevated temperatures and lengthy processing times may be required to obtain sufficient cure of the adhesive. The application of heat may melt, distort the dimensions or change the surface characteristics of the plastic. The long cure times can make the hot air process costly to scale up for high volume manufacturing.

There is therefore a continuing need for ink-jet cartridge components and assembly methods that are economical and reliable.

SUMMARY OF THE INVENTION

A side plug for an ink-jet cartridge body, and methods of attaching the side plug to the cartridge body, are disclosed. The side plug seals a mold access hole in the cartridge body. The side plug is preferably formed of a carbon fiber filled PET (Polyethylene Terephthalate) material; the carbon content of the side plug allows microwave curing of the epoxy adhesive used to attach the side plug to the cartridge body. The side plug may have sculpted protuberances which extend into the cartridge body to form complex ink channels.

Other aspects and advantages of the present invention will become apparent from the following detailed description, taken in conjunction with the accompanying drawings, illustrating by way of example the principles of the invention.

BRIEF DESCRIPTION OF THE DRAWINGS

These and other features and advantages of the present invention will become more apparent from the following detailed description of an exemplary embodiment thereof, as illustrated in the accompanying drawings, in which:

FIG. 1 is an exploded isometric view of an ink-jet cartridge body structure employing a unitary body structure, in which embodiments of the present invention may be utilized.

FIG. 2 is a top view of the unitary body structure of the cartridge of FIG. 1.

FIG. 5 is a partial longitudinal cross-sectional view of the body structure taken along line 5—5 of FIG. 2.

FIG. 6 is a partial cross-section view of the body structure taken along line 6—6 of FIG. 4.

FIG. 7 is a partial cross-sectional view of the body structure taken along line 7—7 of FIG. 4.

FIG. 8 is a cross-sectional view of the nosepiece region taken along line 8—8 of FIG. 4.

FIG. 9 is a schematic diagram illustrative of the ink flow paths from the respective ink compartments to the ink slots in the nose piece area.

DETAILED DESCRIPTION OF AN EXEMPLARY EMBODIMENT

Figure 3:
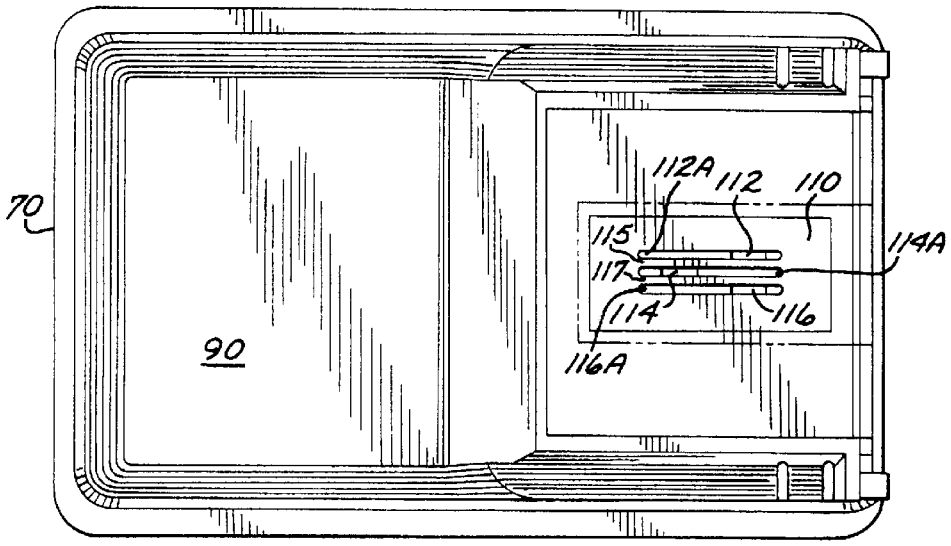
FIG. 3 is a bottom view of the unitary body structure.

An exemplary ink-jet cartridge body structure assembly 50 with which embodiments of the present invention may be utilized is illustrated in FIG. 1, including a separate top lid 60 and a unitary body 70. The body 70 is a one-piece injection molded part in this embodiment.

The body 70 includes two interior walls which meet in a "T" to define, with the body side walls, three ink compartments. Thus, the body 70 has opposed longitudinal side walls 72, 74, and opposed end walls 76, 68 which define an interior cartridge volume. A longitudinally oriented interior wall 80 is equally spaced from the two longitudinal walls 72, 74, and meets transverse interior wall 82 which runs between walls 72, 74 and is parallel to the end walls 76, 78. The exterior walls 72–78 and the interior walls 80–82 with a bottom wall structure described below define three interior ink compartments 84, 86, 88. In one embodiment, the length of the wall 80 is selected such that the respective volumes of the compartments are equal. In other embodiments, the wall length could be selected such that the volume of compartment 88 is larger or smaller than the volumes of compartments 86 and 88. A larger compartment could be used for an ink color which typically experiences higher usage rates than ink color for the inks held in the compartments 86, 88. The compartments in this exemplary embodiment receive foam structures (not shown in FIG. 1) which hold the ink in open foam cells, and create slight negative pressure through capillary action, as is well known in the art.

FIG. 2 shows a top view of the body 70, illustrating the three compartments 84–88 and the bottom wall structure 90. Also shown are respective standpipe structures 92, 94, 96 which protrude from the bottom wall and engage the foam structures when installed in the compartments. The bottom wall structure has defined therein openings 98, 100, 102 in the respective compartments to allow ink to flow into ink channels defined in a nosepiece region below the bottom wall 90 to ink feed slots at a printhead mounting region.

FIG. 3 is bottom view of the body 70, illustrating the printhead mounting region 110 and respective ink feed slots 112, 114, 116 which are formed in grooves 112A, 114A, 116B formed in the printhead mounting region. Narrow lands 115 and 117 are defined between adjacent grooves 112A, 114A and 114A, 116A. In this exemplary embodiment, the slots and lands have widths of 0.5 mm, so that the slots are spaced 1 mm apart center-to-center. As will be explained more fully below, a printhead structure with three ink-jet nozzle arrays are mounted to the region 110. The nozzle arrays are fed by ink flowing through the respective feed slots from the ink compartments.

Figure 4:
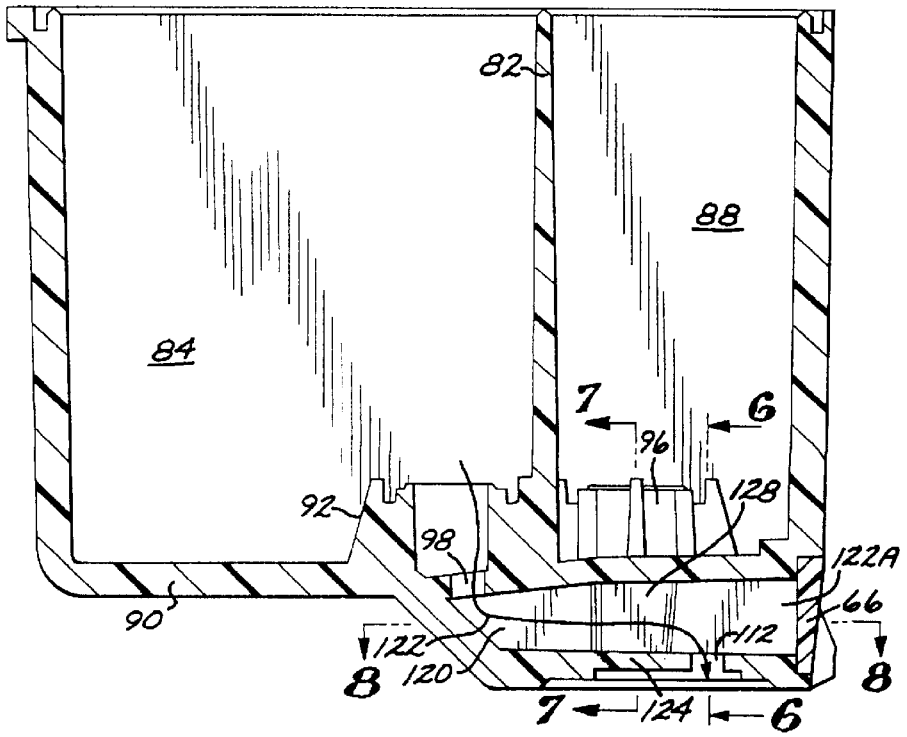
FIG. 4 is a longitudinal cross-sectional view of the body structure taken along line 4—4 of FIG. 2.

The cross-sectional view of FIG. 4, taken along line 4—4 of FIG. 2, illustrates the nosepiece structure 124, the structure of the standpipe 92, and the opening 98 formed through the bottom compartment wall 90. The opening 98 is in communication with a side ink channel 120, which leads to ink feed slot 112 formed in the nosepiece bottom wall 124 in the mounting region 110. The channel 120 thus provides an ink flow path, indicated by arrow 122, from reservoir 84 through opening 98, through the channel 120 and feed slot 112 to the printhead mounting region 110. This channel shape can be modified by the addition of sculpted protuberances (not shown in FIG. 4) to the side plug 66 to improve ink fill and air management in the cartridge and to reduce the occurrence of printhead deprime. Also visible in FIG. 4 is the standpipe structure 96 for the front compartment 88.

FIG. 5 shows a cross-section of the nosepiece and front compartment 88, with the standpipe structure 96 and opening 102, which tapers into the feed slot 114 formed in the printhead mounting region 110 of the nosepiece. It will be seen that opening 102 communicates directly with the printhead mounting region 110 through vertical channel 126 to slot 114. This feature is further illustrated in the cross-sectional view of FIG. 7. The vertical channel 126 is formed through nosepiece structure at 128 (FIG. 4).

A nosepiece wall structure 130 runs between the nosepiece structure at 128 up to the slide insert opening 76A formed in the wall 76 of the body. When the sealing plug 66 is mounted in the opening 76A, it is sealed to the wall 76 at the periphery of the opening and also to the exposed edge of the wall 130 in this exemplary embodiment, to prevent ink from one side channel from mixing with ink from the other side channel. This is illustrated in FIG. 8.

FIG. 9 schematically illustrates the side ink channels 120 and 140, which respectively run from the outlet ports 98, 100 formed in the respective reservoirs 84, 86 to the ink flow slots 112, 116 in the nosepiece bottom wall at the printhead mounting region.

Figures 10A, 10B:
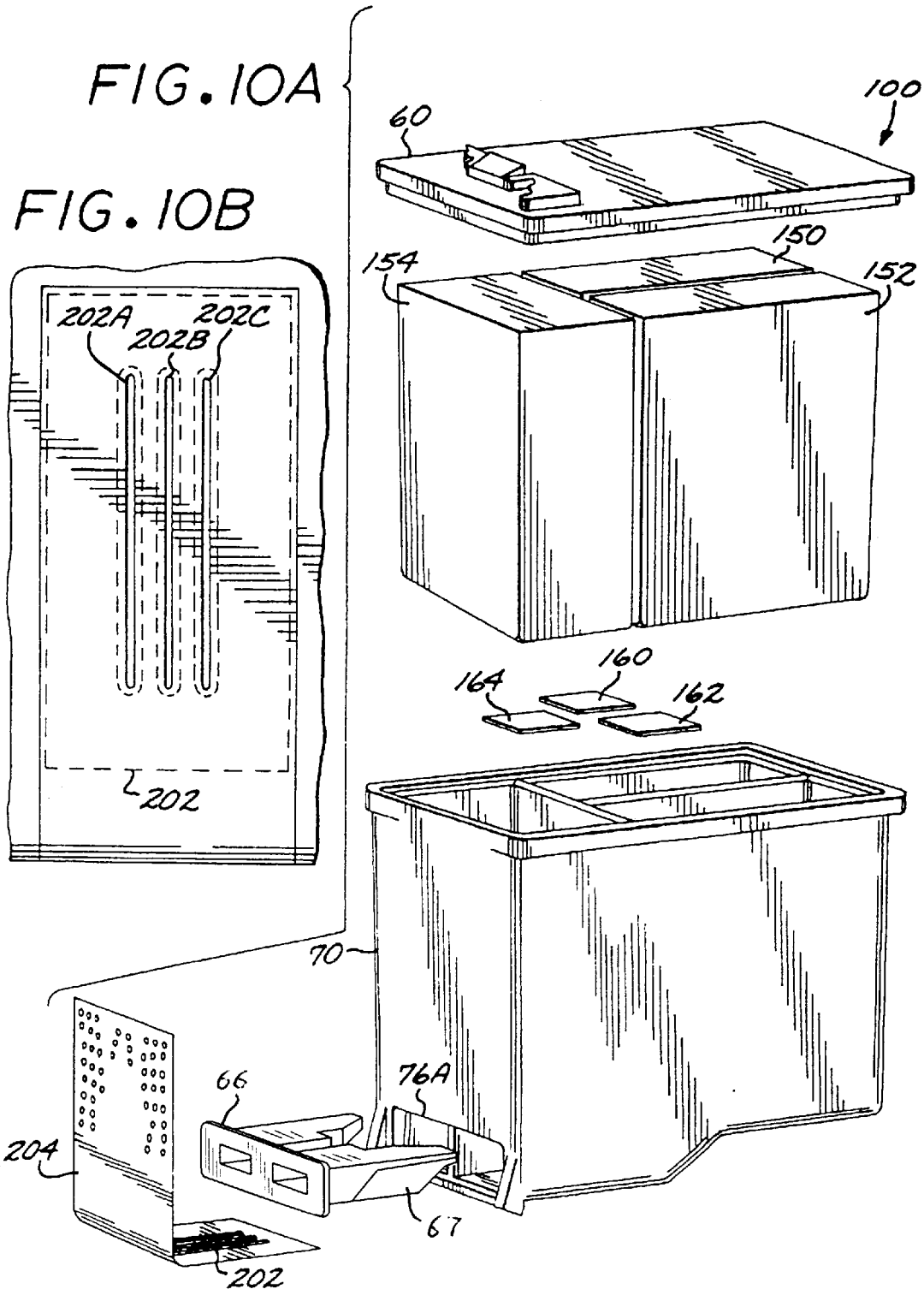
FIG. 10A is an exploded view of the ink-jet print cartridge of FIG. 1 with the printhead TAB circuit, plug, foam, and filter screen elements.
FIG. 10B is a bottom view of the printhead substrate employed in the printhead TAB circuit.

FIG. 10A illustrates in exploded view an ink-jet cartridge 200 a unitary cartridge structure 70 and lid 60 as described with respect to FIGS. 1–9. The cartridge 200 includes a printhead substrate 202 assembled to a TAB circuit 204, which is mounted to the cartridge body 70. The TAB circuit 204 has formed thereon the connecting circuit traces and pads used to interconnect firing resistors with the printer driver circuits, as is generally well known in the art. The substrate 202 has formed in the planar surface adjacent the mounting region three feed slots 202A, 202B, 202C (FIG. 10B) which feed the firing chambers (not shown) of the printhead substrate with liquid ink. These substrate slots are positioned so that each substrate slot is adjacent a corresponding feed slot 112, 114, 116 at the printhead mounting region 110. The printhead is fixed to the printhead mounting region 110 of the body structure 70 in this exemplary embodiment by adhesive beads formed around the periphery of each feed slot 112, 114, 116 to form a barrier between the respective ink feed slots and so as to direct ink from one reservoir to the appropriate substrate feed slot on the substrate 202. The use of adhesive to attach printhead substrates to body mounting regions is known in the art.

In an exemplary embodiment, each substrate slot 202A–202C is associated with a corresponding printhead nozzle array, such that ink supplied to a given substrate slot will feed firing chambers of the corresponding nozzle array. Three color cartridge, there will be three nozzle arrays, and each will be positioned to receive ink from a corresponding one of the supply reservoirs 84–88.

Also shown in FIG. 10 are the three foam bodies 150, 152, 154 which are inserted into the corresponding reservoirs 84–88. The foam bodies create slight negative pressure to prevent ink drool from the printhead nozzles under nominal conditions, as is known in the art. Fine mesh filters 160, 162, 164 are fitted over the respective standpipe openings and between the standpipes and the foam structures to provide filtration of particulates and air bubbles.

The body 70 is preferably fabricated from a vapor barrier material to prevent ink from diffusing through the body walls. An exemplary material suitable for the purpose and for injection molding is glass-reinforced PET, although other materials can alternatively be employed.

A side plug 66 having sculpted protuberances 67 for forming complex ink channels within the nosepiece of the cartridge is also shown in FIG. 10A. The side plug serves to seal the insert access hole in the body after the molding process is completed and form more optimal ink channels in the nosepiece of the cartridge.

Figure 11:
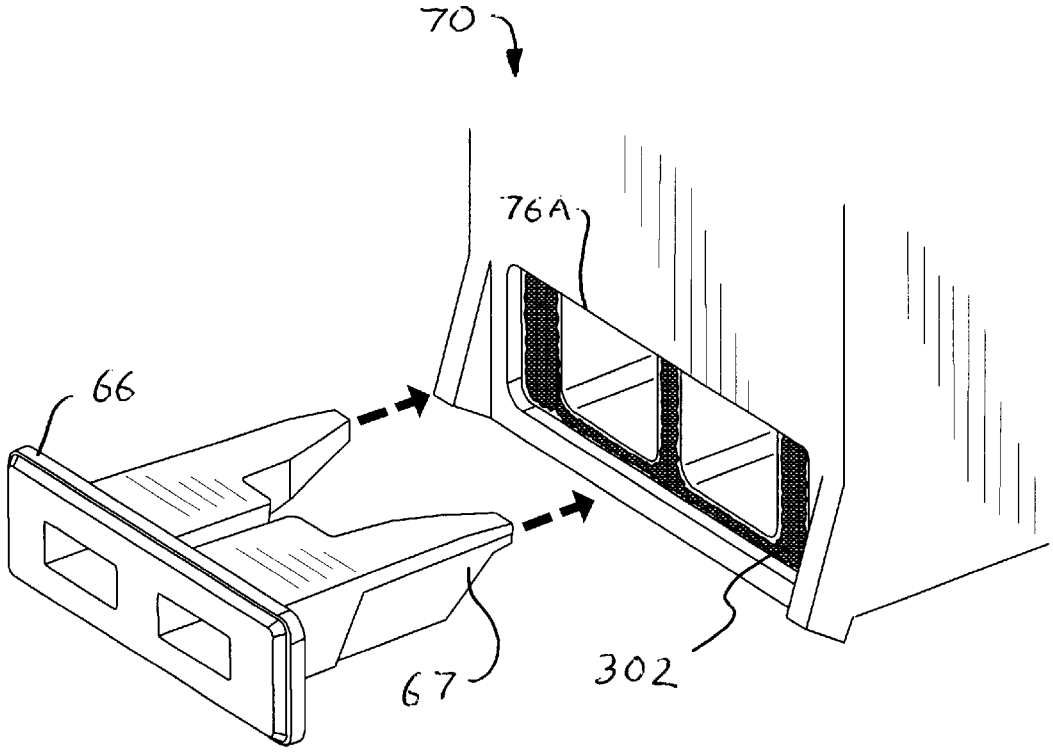
FIG. 11 is an enlarged exploded view of an embodiment of the cartridge body and plug, illustrating how heat-curable epoxy may be applied to the body, and the plug inserted into the body.

FIG. 11 is an enlarged view of the side plug 66 and cartridge body 70 according to an embodiment of the invention. Prior to insertion of the side plug 66 into the mold slide insert access hole 76A of the cartridge body, a heat-curable adhesive 302 is deposited on the cartridge body. After insertion of the side plug and curing of the adhesive, the resulting seal must be resistant to the chemical effects of prolonged contact with ink, and the mechanical effects such as ultrasonic welding of the cartridge lid to the cartridge body.

Since the seal formed between the side plug 66 and the cartridge body 70 is somewhat shielded by front of the side plug 66, thermal heating techniques such as hot air cure processes are problematic. Hot air cure processes would apply heat to other portions of the pen body, potentially causing distortion of the body. Hot air cure processes also have limited heat rate control, which can potentially cause porosity of the adhesive, leading to ink leaks. Thus, the present invention utilizes microwave radiation for curing the adhesive seal.

To allow for selective heating of the side plug 66 by microwave radiation, as discussed below, the plug is formed of carbon fiber filled PET (Polyethylene Terephthalate). In an exemplary embodiment of the side plug, the plug material comprises approximately 20% carbon fiber.

Figure 12:
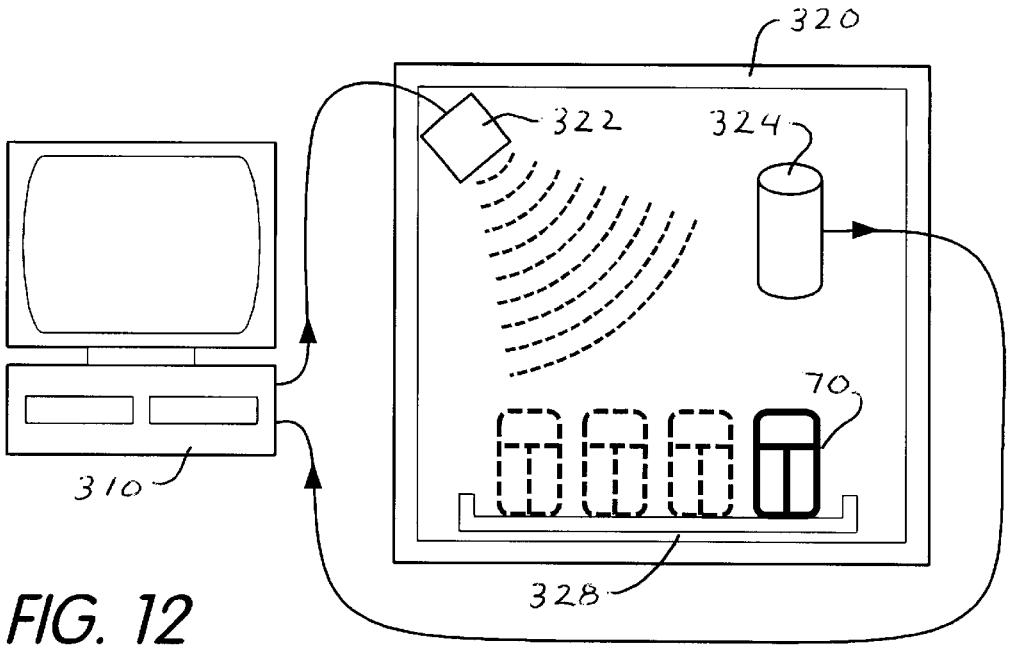
FIG. 12 is a schematic illustration of how the epoxy may be cured in a microwave chamber under control of a computer in an embodiment of the invention.

FIG. 12 schematically illustrates the curing process of the adhesive seal between the side plug 66 and cartridge body 70. In the exemplary implementation, the cure process is under feedback control of a computer 310. Cartridge bodies 70 with the inserted side plugs are placed in a microwave chamber 320. The chamber includes a microwave source 322 and a monitoring device 324 for optically detecting the temperature of the side plug. In operation, the computer 310 controls the generation of microwave radiation by the microwave source 322, while monitoring the temperature of the side plug in the cartridge body. In a production system, multiple cartridge bodies are irradiated simultaneously, as indicated by the cartridge bodies shown in dashed lines, while the temperature of a single side plug is monitored. Preferably the cartridges rest on a microwave-transparent tray 328, fabricated from a material such as Teflon.

Figure 13:
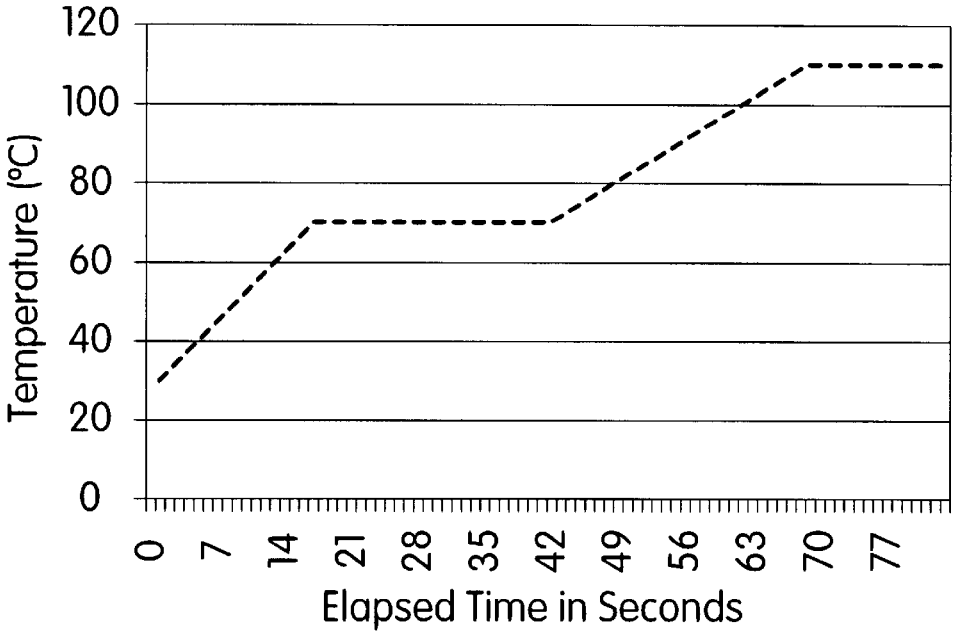
FIG. 13 is a plot of temperature versus time for an embodiment of the epoxy cure process.

The time and temperature profile for the cure process that provides the best seal characteristics is empirically determined; a exemplary profile is illustrated in FIG. 13. The computer 310 continually monitors the temperature of the side plug in cartridge body 70, and adjusts the microwave radiation amplitude in the chamber to substantially follow the temperature curve shown in FIG. 13. During the curing process, the carbon doping in the side plug absorbs microwave energy and heats up the entire side plug. Heat then transfers from the side plug to the adhesive in contact with the side plug, curing the adhesive and bonding the side plug to the pen body.

To achieve uniform heating of the multiple side plugs within the microwave chamber, the exemplary implementation varies the frequency of the microwave radiation from 7.9 GHz to 8.7 GHz, sweeping the frequency range 4096 times per second. Different frequency ranges and sweep rates may also be employed, as is known in the art.

Figure 14:
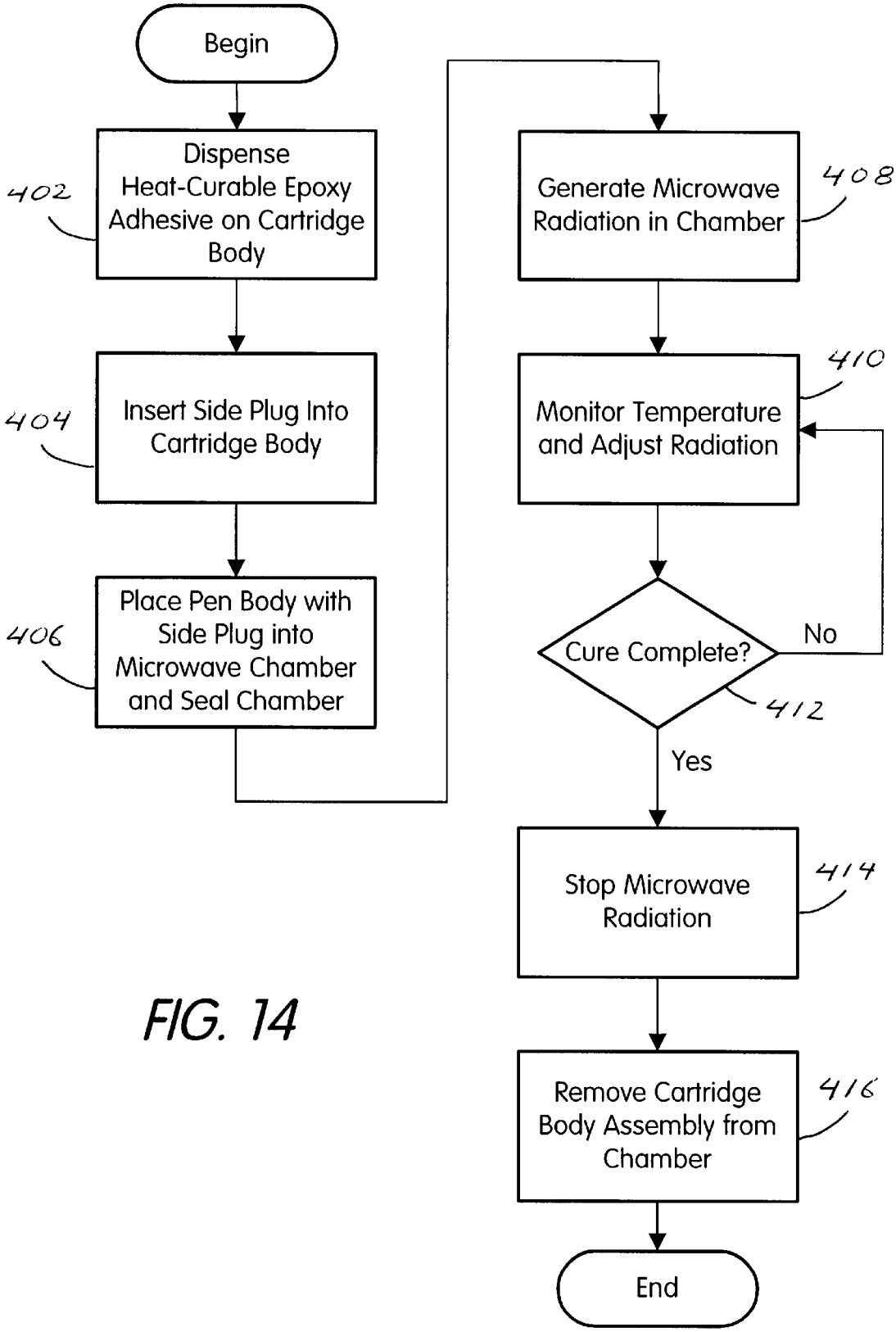
FIG. 14 is a flow diagram illustrating an embodiment of the epoxy cure process.

FIG. 14 is a flow diagram summarizing an exemplary method of the invention. Heat-curable epoxy adhesive is dispensed 402 on the cartridge body, and the carbon-doped side plug is inserted 404 into the body. The pen body with the inserted side plug is placed into the microwave chamber and the chamber is sealed 406. Microwave radiation is introduced into the chamber 408. A computer monitors the temperature of a side plug, and adjusts the microwave radiation to follow a predetermined temperature profile 410. The computer determines that the cure process is complete 412, and stops the microwave radiation 414. The cartridge body assembly is removed from the microwave chamber 416.

Advantages of microwave heating of the carbon-doped side plugs are that it allows the adhesive to be heat cured without the need to transfer heat through plastic surfaces. Melting, distorting and surface changes of the plastic are reduced or eliminated. Additionally, the localized microwave heating of carbon doped plastics reduces unwanted heat applied to materials surrounding the adhesive joint. The technology enables heat curing of adhesives in product designs where adhesive joints are located inside of a complex assembly. Microwave energy effectively penetrates and heats carbon doped plastics to cure adhesives when geometry of the parts prevents direct application of heat by other methods. Previously, these designs would have been difficult to manufacture since heat could not be applied to the adhesive by other methods.

While the present invention has been particularly shown and described with reference to the foregoing exemplary and alternative embodiments, those skilled in the art will understand that many variations may be made therein without departing from the spirit and scope of the invention as defined in the following claims. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A side plug for sealing a mold slide insert access hole in the body structure of an ink-jet printer cartridge, the cartridge having a plurality of ink reservoirs and a printhead region, the cartridge further having a nosepiece region with a manifold providing ink routing between the ink reservoirs and the printhead region, the side plug comprising:

a sealing portion for closing the mold slide insert access hole in the body of an ink-jet cartridge when the side plug is adhesively bonded to a cartridge;

at least one protuberance extending from the sealing portion for forming a portion of an ink manifold channel when the side plug is inserted into a nosepiece region of an ink-jet cartridge;

the side plug formed of a primary moldable material combined with an additive material, the additive material selectably heatable by microwave radiation.

2. The side plug for sealing a mold slide insert access hole in the body of a print cartridge of claim 1, wherein the primary moldable material substantially comprises Polyethylene Terephthalate (PET).

3. The side plug for sealing a mold slide insert access hole in the body of a print cartridge of claim 1, wherein the additive material selectably heatable by microwave radiation substantially comprises carbon fibers.

4. The side plug for sealing a mold slide insert access hole in the body of a print cartridge of claim 3, wherein the carbon fibers comprise about 20% of the side plug material.

5. The side plug for sealing a mold slide insert access hole in the body of a print cartridge of claim 1, wherein the at least one protuberance extending from the sealing portion comprises two protuberances.

6. An ink-jet print cartridge, comprising:

a unitary body having a plurality of ink reservoir compartments and an external wall, each compartment including an outlet port through which ink passes to feed ink to an ink-jet printhead nozzle array, a printhead nozzle array mounting region, and an ink manifold structure including a plurality of corresponding ink channels each leading from a corresponding outlet port to a feed opening formed at the printhead mounting region, said plurality of ink channels including a first ink channel leading from a first outlet port for a first ink reservoir compartment to a first feed opening and a second ink channel leading from a second outlet port for a second ink reservoir compartment, said first channel and said second channel including respective first and second channel portions extending in a generally parallel relationship to an access opening formed in said external wall, the body and manifold structure formed as a unitary one-piece structure;

a plurality of foam members each disposed in a corresponding one of said ink reservoir compartments;

a printhead mounted to the mounting region;

a lid attached to the body to enclose the compartments; and a side plug structure adhesively attached to the body with a heat-curable adhesive, the side plug sealing the access opening in the unitary body, the side plug formed of a material having a greater capacity for heating by microwave radiation than the unitary body, foam members, and lid.

7. The ink-jet cartridge of claim 6, further including a plurality of supplies of liquid ink of different colors disposed in the respective ink compartments.

8. The ink-jet cartridge of claim 6 wherein the body and manifold structure are formed as a unitary molded part.

9. The ink-jet cartridge of claim 6, wherein the material having a greater capacity for heating by microwave radiation comprises a mixture of Polyethylene Terephthalate (PET) and an additive material having a high capacity for heating by microwave radiation.

10. The ink-jet cartridge of claim 9, wherein the additive material comprises carbon fibers.

11. The ink-jet cartridge of claim 10, wherein the carbon fibers comprise about 20% of the material having greater capacity for heating by microwave radiation.

12. The ink-jet cartridge of claim 11, wherein the heat-curable adhesive comprises an epoxy.

13. A method of manufacturing a cartridge for an ink-jet printer, the cartridge having multiple ink reservoirs, a nosepiece region, and a printhead mounting region, the nosepiece region including a manifold for routing ink from the multiple ink reservoirs to the printhead mounting region, the method comprising:

injection molding a first plastic material to form a cartridge body structure, the body structure having a plurality of compartments for serving as ink reservoirs and a nosepiece region including first portions of a manifold for routing ink, the first portions of the manifold formed by a mold slide insert, resulting in a mold access hole in the nosepiece region of the body structure;

forming a side plug member of a second plastic material, the second plastic material being more susceptible to heating by microwave radiation than the first plastic material;

placing the side plug member in the mold access hole in the nosepiece region of the body structure to seal the access hole and to form remaining portions of the manifold, with a heat-curable adhesive interposed between at least some areas of the cartridge body structure and at least some areas of the side plug member; and providing microwave radiation to selectively heat the side plug member.

14. The method of manufacturing a cartridge for an ink-jet printer of claim 13, wherein the second plastic material comprises a mixture of Polyethylene Terephthalate (PET) and an additive material having a high capacity for heating by microwave radiation.

15. The method of manufacturing a cartridge for an ink-jet printer of claim 14, wherein the additive material comprises carbon fibers.

16. The method of manufacturing a cartridge for an ink-jet printer of claim 15, wherein the carbon fibers comprise about 20% of the second plastic material.

17. The method of manufacturing a cartridge for an ink-jet printer of claim 13, wherein the heat-curable adhesive comprises an epoxy.

18. The method of manufacturing a cartridge for an ink-jet printer of claim 13, further comprising:

monitoring the temperature of the side plug while providing the microwave radiation to selectively heat the side plug member, and adjusting the intensity of the microwave radiation in response to the temperature to cause the temperature of the side plug to substantially follow a predetermined time and temperature profile.

19. The method of manufacturing a cartridge for an ink-jet printer of claim 18, wherein monitoring the temperature of the side plug comprises detecting infrared radiation emitted by the side plug during heating.

20. The method of manufacturing a cartridge for an ink-jet printer of claim 18, wherein monitoring the temperature of the side plug and adjusting the intensity of the microwave radiation are both controlled by a computer.

21. The method of manufacturing a cartridge for an ink-jet printer of claim 13, wherein providing microwave radiation to selectively heat the side plug member further comprises sweeping the frequency of the microwave radiation.

22. The method of manufacturing a cartridge for an ink-jet printer of claim 21, wherein the microwave radiation is swept in frequency from about radiation from about 7.9 GHz to about 8.7 GHz.

23. The method of manufacturing a cartridge for an ink-jet printer of claim 21, wherein the microwave radiation is swept about 4096 times per second.

* * * * *